US006149488A

United States Patent [19]

Stark

[11] Patent Number: 6,149,488

[45] Date of Patent: Nov. 21, 2000

[54] WATER BALLOON DART

[76] Inventor: Harvey Stark, 4579 Hampton Avenue, Montreal, Quebec, Canada, H4A2L5

[21] Appl. No.: 09/211,784

[22] Filed: Dec. 15, 1998

Related U.S. Application Data

[63] Continuation-in-part of application No. 29/084,914, Mar. 12, 1998, Pat. No. Des. 417,471.

[51] Int. Cl.[7] ..... A63H 27/10

[52] U.S. Cl. ..... 446/220; 446/34

[58] Field of Search ..... 446/34, 220; 473/569, 473/578

[56] References Cited

U.S. PATENT DOCUMENTS 3,411,778 11/1968 Barry ..... 446/220 X
3,457,669 7/1969 Green ..... 446/220 X
5,588,897 12/1996 Valentino ..... 446/220 X
5,928,049 7/1999 Hudson ..... 473/578 X

*Primary Examiner*—John A. Ricci
*Attorney, Agent, or Firm*—Lewis Anten, Esq.

[57] ABSTRACT

A toy water balloon dart system is disclosed comprising a dart tail that attaches to a water balloon before the water balloon dart is propelled over a distance for the amusement of children and adults.

The toy water balloon, in one or more embodiments, also includes a pump for filling the balloon with fluid. The pump has a flexible housing with a reservoir with an inlet port and an outlet port. A first valve is associated with the inlet port to permit fluid to enter through the inlet port into the pump.

6 Claims, 7 Drawing Sheets

WATER BALLOON DART

RELATED APPLICATION

This application is a continuation-in-part of U.S. design patent application Ser. No. Des. 29/084,914, filed Mar. 12, 1998, now U.S. Pat. No. Des. 0,417,471, incorporated herein by reference.

BACKGROUND OF THE INVENTION

1. Field of the Invention

The present invention relates to a toy water balloon dart assembly.

2. Description of the Related Art

A water balloon is usually prepared by attaching the neck of a conventional balloon to a water spout with the water running inside the balloon until the balloon is filled with water. The user is required to hold the neck of the increasingly heavy balloon under the spout until the balloon is full of water. This may present a problem as the portion of the neck held by the user gradually becomes more and more slippery and the balloon may slip and fall.

A conventional infant aspirator may also be employed for filling a balloon with water. However, this may present a problem as the aspirator nozzle is not designed to fit the neck of a conventional balloon which may slow down the filling operation and frustrate unnecessarily the user.

Alternatively, a number of known water pumping devices have been used by children trying to fill a balloon with water. For example, children have been known to tie the neck of a balloon to a conventional toy high pressure water gun and then shoot water continuously inside the balloon trying to fill the balloon with water. This operation is not easy to accomplish as the water gun muzzle is not designed to fit the neck of a water balloon which may frustrate the user and result in broken balloons.

Various water pumps have been employed in the past to fill a balloon with water. Such pumps are usually portable, and have nozzles specifically designed for use with water balloons. Such devices typically have a nozzle designed to fit the neck of a standard balloon and should be capable of fast filling operation thereby eliminating all of the above-described problems. Such a device should be usable not only in the home but anywhere where there is a ready supply of water, such as in a swimming pool, lake, ocean or the like.

After the balloon is filled with water, the balloon is often used by children in games that usually involve propelling the water-filled balloon in the air at a target for amusement. Depending to a certain extent on the amount of water contained in the balloon, the speed of the propelled balloon, and the target surface, the water balloon may splash at impact with the target shooting water over a relatively large area for the delight of children playing with the water balloon.

Variations of this popular game are known. One such game involves using a so-called "water bazooka". The water bazooka employs a water balloon mounted in a barrel which is detachably connected to a trigger mechanism. The water balloon is secured by an elastic band which is also attached to the trigger mechanism. The actuation of the trigger mechanism propels the water balloon in the air. This type of launching requires time to master and may not be easy to use by young children. This water balloon launching device is also relatively heavy, is manufactured from a number of parts and is relatively expensive.

Another known water balloon launching device is a water balloon catapult which includes traditional slingshot components. The catapult is equipped with a finger guard to protect the fingers of the user during use of the device, however, this type of launching device may not be safe for use by young children and requires some time from the user to master its operation.

A variation on the above theme is the water balloon toss sling which includes a pouch adapted for seating a water-filled balloon and a pair of cords permitting rotational movement for tossing the water balloon from the sling. Such a device may be unsafe for use by young children and may injure the user if not used properly.

Accordingly, the need arises for a simple water balloon toy that can be easily propelled in the air by children or adults, is safe, inexpensive, portable and can be reused. Such a water balloon toy should preferably be used in combination with a portable, easy to use, efficient and hand-held water balloon pump designed specifically for use with water balloons. Such a combination should be easy to assemble and safe to use so as to be enjoyed by young children and adults alike.

SUMMARY OF THE INVENTION

The present invention is directed to a toy water balloon dart system for the amusement of children and adults. The water balloon dart system of the present invention comprises a tail for facilitating flight of a water balloon. The tail has a front end configured for removably coupling to a portion of a filled water balloon.

In one embodiment of the present invention, the tail has a body with a plurality of aerodynamic longitudinal fins spaced apart from one another extending along at least a portion of the length of the body for facilitating flight of the water balloon dart. The tail body has a shaft-like configuration and is generally in the shape of a hollow cylinder aerodynamically tapered at one end similar to the tail of an aircraft. The aerodynamic tail which resembles the tail of a dart helps the water balloon maintain an even trajectory to improve the distance and accuracy of a thrown water balloon. In the preferred embodiment of the present invention, the tail is made of a light-weight, elastic material to prevent any damage or injury to the target. The tail body includes a slit at the front end of the tail, preferably in the shape of a key hole, for receiving and securing a portion of a filled water balloon.

To assemble the dart, the user inserts the knotted neck of the water-filled balloon into the key-hole slit while pulling the balloon neck portion below the knot along the slit in a direction toward the back end of the tail until the water-filled balloon is securely coupled to the front end of the tail body. Having assembled the toy water balloon dart, the user manually propels the water-filled balloon dart in the air at a target with the filled water balloon possibly splashing on impact and shooting water in all directions for everyone's amusement.

A pump for filling the water balloon with water of the type well-known in the art may typically comprise a flexible housing having a reservoir with a fluid inlet port for communicating with an outside body of water and a fluid outlet port. The fluid outlet port is configured for coupling to a water balloon for filling the water balloon with water contained in the pump reservoir. A valve is associated with the fluid outlet port having an open position for permitting fluid to exit from the pump through the outlet port and a closed position for enabling suction of fluid into the pump through the inlet port. Compressing the flexible housing of the pump causes the valve to be in the open position, and decompressing the flexible housing causes the valve to be in the closed position. The valve preferably has a disk-like configuration and is provided with an inner tongue formed by a partial annular cut of the valve.

Alternatively, the pump for filling the water balloon with water may have a second valve associated with the outlet port, with an open position for permitting fluid to exit from the pump through the outlet port, and a closed position for enabling suction of fluid into the pump through the inlet port. Compressing the flexible housing causes the first valve to be in the closed position and the second valve to be in the open position, and decompressing the flexible housing causes the first valve to be in the open position and the second valve to be in the closed position. The pump preferably includes a nozzle coupled to the outlet port for injecting fluid into the water balloon and for frictionally securing the second valve over the outlet port inside the nozzle. The nozzle is configured to be easily inserted into the open end of an unfilled water balloon such that the balloon forms a tight seal around the nozzle to prevent water from leaking during the filling of the balloon.

The pump may also include a cap coupled to the inlet port for frictionally securing the first valve under the inlet port inside the cap, the cap being open on both ends for allowing fluid flow into the inlet port. The first valve preferably has a disklike configuration and is provided with an inner tongue formed by a partial annular cut of the first valve. The second valve is preferably identical in shape, construction and function to the first valve. Each valve permits fluid flow in only one direction. The valves operate such that when one valve is open, the other valve is closed and vice versa. Such a valve arrangement permits the continuous filling of a balloon attached to the nozzle via the outlet port while the cap enclosing the inlet port is in communication with a body of water.

The pump is used by inserting the inlet port of the pump in a body of water such as a pool, sink, or pail for example, with the user manually and repeatedly squeezing the outer walls of the pump until water squirts out of the nozzle. The user then securely inserts the nozzle into the opening in the neck of a conventional balloon and manually pumps the balloon full of water. The filled water balloon is then removed from the nozzle and the open end of the balloon is tied in a knot, leaving a portion of the balloon neck unfilled and hanging below the knot for handling.

These and other embodiments of the present invention will become apparent from the following detailed description of the invention and accompanying drawings.

DETAILED DESCRIPTION OF THE DRAWINGS

The following description includes the best mode presently contemplated for carrying out the invention. This description is not to be taken in a limiting sense, but is made merely for the purpose of describing the general principles of the invention. The scope of the invention should be determined with reference to the claims.

Figure 1:
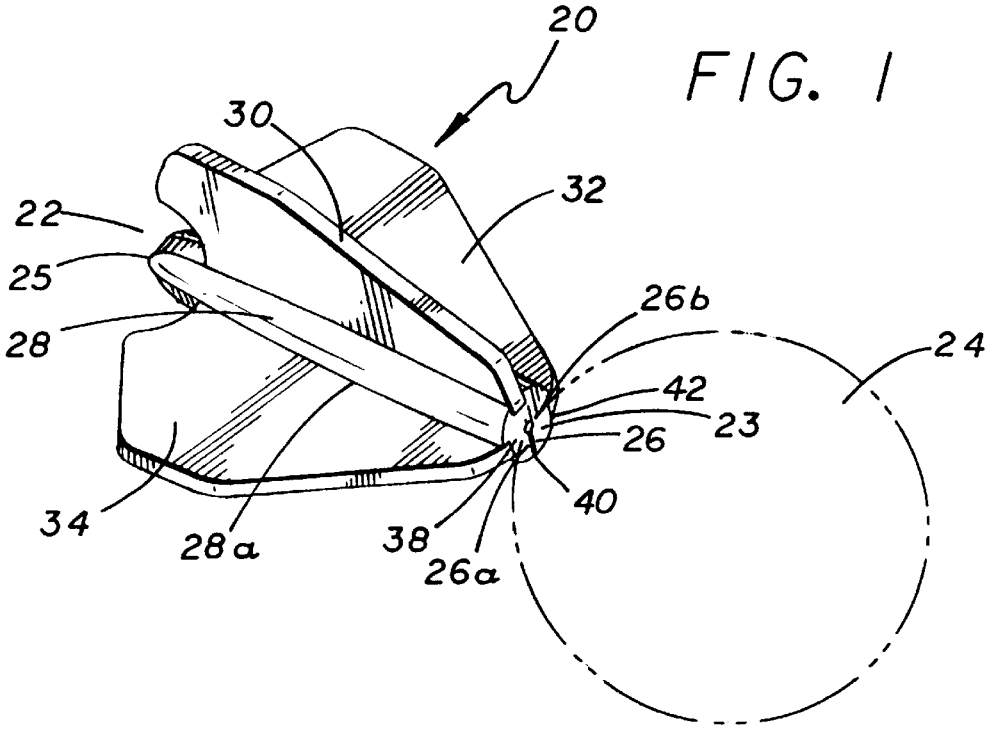
FIG. 1 is a front side perspective view of a toy water balloon dart of the present invention having an aerodynamic tail coupled to a water balloon shown in dotted line.

In FIG. 1, a toy water balloon dart in accordance with the present invention is shown and generally referred to by the numeral 20. In the preferred embodiment of the present invention, toy water balloon dart 20 has a tail 22 with a front end 23 and a back end 25. A water balloon 24 adapted to be filled with a fluid is shown in dotted line coupled to the front end 23 of tail 22. Tail 22 is shaped like the tail of a conventional dart and has a body 28 having a shaft-like configuration. The front end 23 of tail body 28 is preferably provided with a slit 26 cut roughly in the shape of a key hole for coupling to water balloon 24. The exterior of tail body 28 has three aerodynamic longitudinal fins 30, 32, and 34 which extend along a portion of the length of the tail body 28 toward the back end 25 of tail 22 for facilitating flight of the water balloon dart. Fins 30, 32 and 34 are solid and shaped like the stabilizing tail fins of a real airborne missile. Fins 30, 32 and 34 are identical in shape and construction and are symmetrically spaced apart from one another at an angle of approximately 110 degrees to ensure aerodynamic stability during flight.

Figure 2:
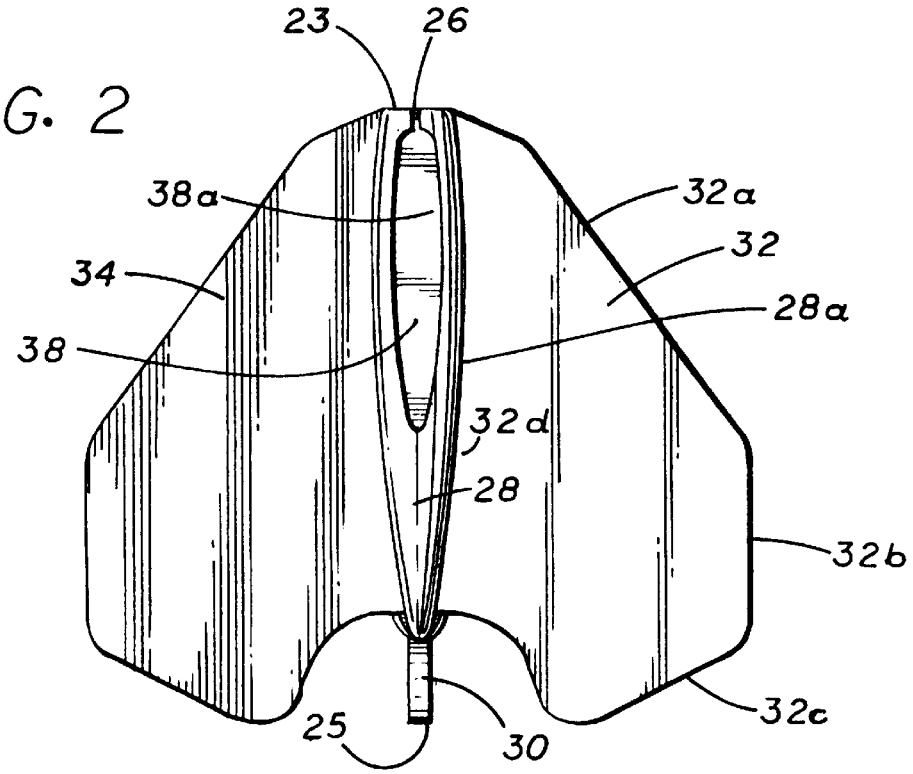
FIG. 2 is a right side elevational view of the tail of FIG. 1.
Figure 3:
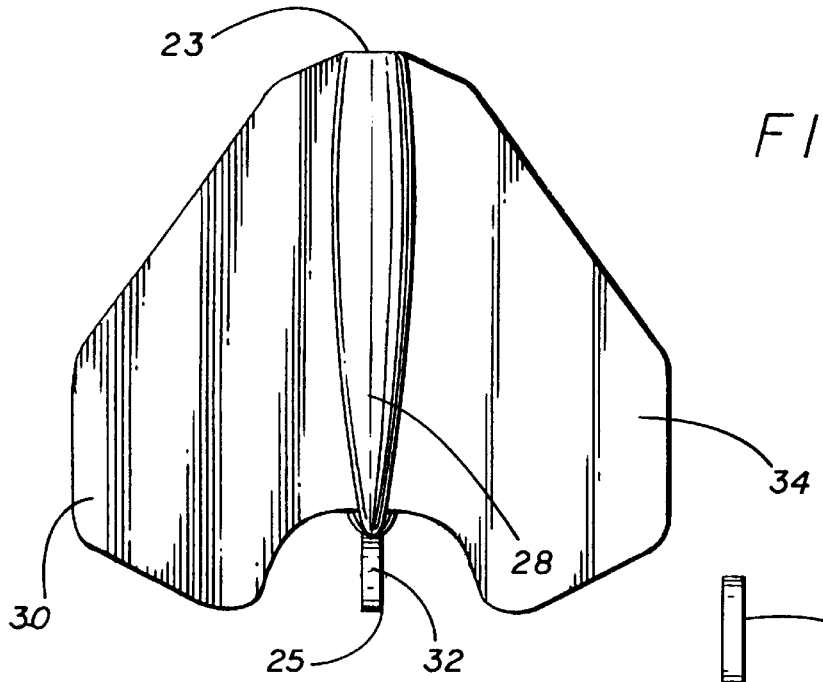
FIG. 3 is a front side elevational view of the tail of FIG. 1.
Figure 4:
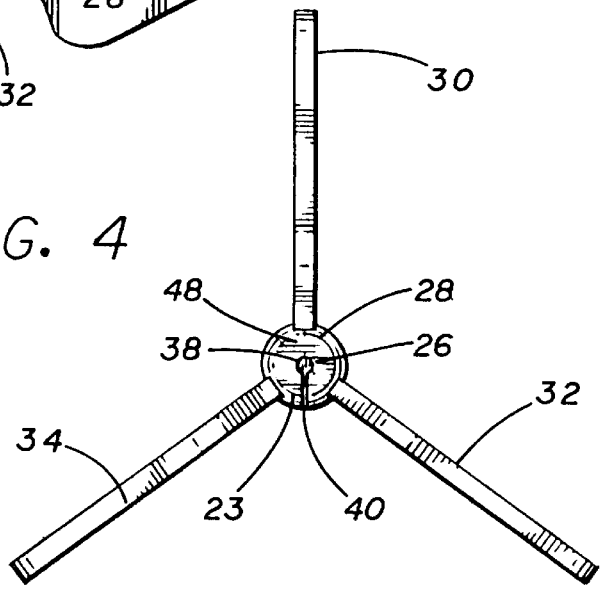
FIG. 4 is a top plan view of the tail of FIG. 1.
Figure 5:
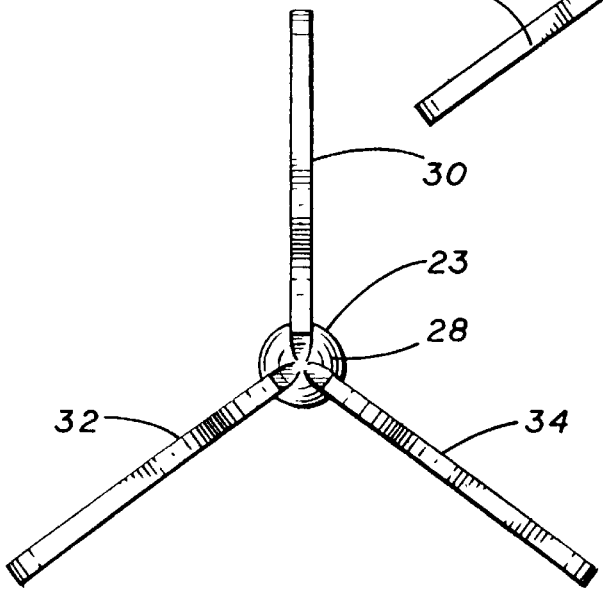
FIG. 5 is a bottom plan view of the tail of FIG. 1.

As shown in FIG. 2, the preferred dimensions of fin 32 are as follows: length of side 32*a* is approximately 2.25 inches, length of side 32*b* is approximately 1.125 inches, length of side 32*c* is approximately 1 inch, length of side 32*d* is approximately 2.75 inches, thickness of fin 32 is approximately 0.125 inches. The preferred dimensions of fins 30 and 34 are identical to the above dimensions. The fins are made of flexible, light-weight synthetic rubber. Other materials and shapes for manufacture of the fins may be used without departing from the intended purpose of the present invention. Each fin is preferably glued to the exterior of tail body 28 with other attachments being possible or may be formed as an integral part of tail 20.

As shown in FIGS. 1, 2, 4, 5 and 7, tail body 28 is generally in the shape of a hollow cylinder and is aerodynamically tapered at the back end 25 similar to the tail of an aircraft. The aerodynamic tail helps the water balloon 24 maintain an even trajectory to improve the distance and accuracy of a thrown water balloon. The preferred length 28*a* of tail body 28 is about 3.25 inches. Front end 42 of tail body 28 has a circular configuration with a preferred diameter of about 0.625 inches and is provided with slit 26 cut roughly in the shape of a key hole having a circular portion 26*b* and an elongated portion 26*c* for receiving the knotted neck of filled water balloon 24. The preferred length 26*a* of slit 26 is about 0.375 inches. The preferred diameter of circular portion 26*b* of slit 26 is about 0.06 inches. The preferred length of elongated portion 26*c* of slit 26 is about 0.25 inches and the preferred width of elongated portion 26*c* is about 0.05 inches.

A portion of the exterior surface of tail body 28 between fins 32 and 34 is provided with a cutout 38 which exposes the hollow inside of tail body 28 and has two arc-shaped sides which connect in the front with slit 26. The preferred width 38*a* of cutout 38 in its widest section is about 0.25 inches. Tail body 28 is preferably made of strong, light-weight and inexpensive plastic that is designed to withstand impact with most targets and can be reused in accordance with the present invention. Other materials may be employed for manufacture of the tail provided that they are suitable for the intended purpose of the inventive device.

The overall preferred weight of dart tail 22 is about 0.35 ounces. It will be appreciated that variations on the aerodynamic shape and weight of tail 22 may be employed provided that they do not depart from the intended purpose of the present invention.

Figure 6:
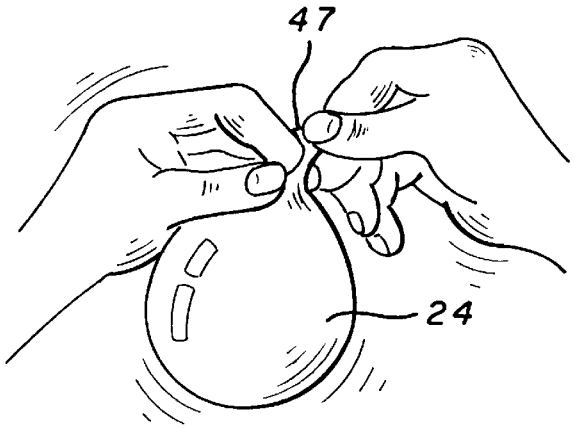
FIG. 6 is a perspective view of a filled water balloon with the neck portion being tied in a knot by a user for use with the aerodynamic tail of the present invention.
Figure 7:
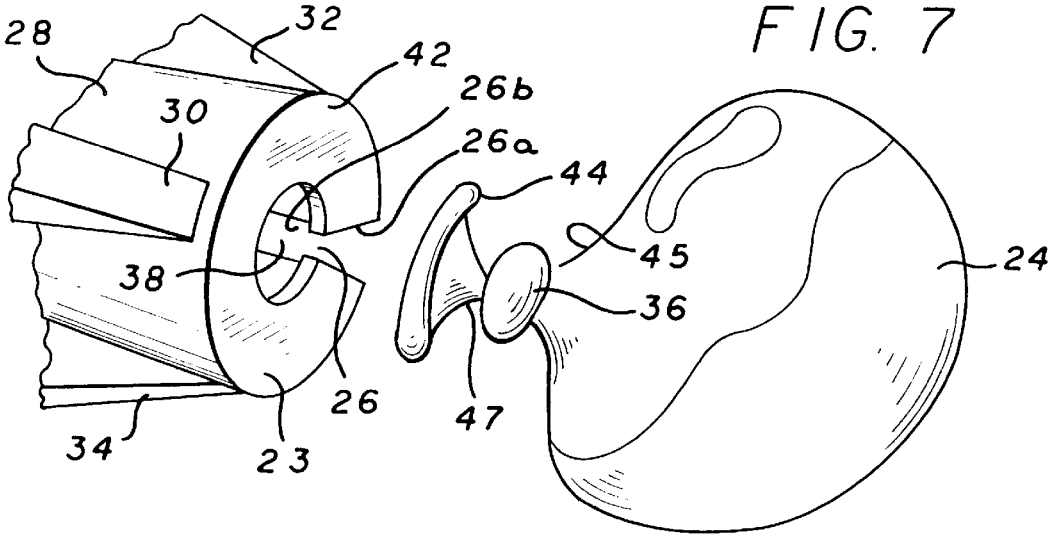
FIG. 7 is an exploded view of the front end of the tail for coupling to the knotted neck portion of a filled water balloon in accordance with the present invention.

As shown in FIGS. 6 and 7, water balloon 24, in the preferred embodiment of the present invention, is a balloon filled with water and tied with a standard knot 36 to prevent escape of the water. Knot 36 has a generally circular cross section and is tied such that unfilled neck portion 44 of balloon 24 remains below knot 36 to facilitate handling the filled water balloon.

Water balloon dart 20 is assembled by coupling the neck 47 of the knotted water-filled balloon 24 to the front portion of tail body 28 via slit 26. The coupling is done manually by the user by pushing knot 36 inside tail body 28 via cutout 38, while at the same time inserting a portion 45 of the filled neck 47 of balloon 24 which is directly above knot 36 inside elongated portion 26*c* of slit 26. The user then pulls on unfilled neck portion 44 via cutout 38 in a direction toward the back end of tail body 28 until neck balloon portion 45 is frictionally lodged inside circular portion 26*b* of slit 26. Circular portion 26*b* of slit 26 being wider than elongated portion 26 of slit 26 in effect securely locks and frictionally holds the neck of filled water balloon 24 inside slit 26 completing the coupling of filled water balloon 24 to front end 42 of tail body 28. By pulling on knot 36, balloon neck portion 45 stretches elastically as it is forced inside slit 26. The forced stretching of the balloon wall as it enters slit 26 pushes more water in the water-filled portion of balloon 24 left outside slit 26 thereby increasing the internal water pressure on the walls of balloon 24. This causes the outside water-filled portion of balloon 24 to stiffen which improves the flight dynamics of the coupled toy water balloon dart.

In the preferred embodiment of the present invention, tail body 28 is provided on front end 42 with a single slit 26 for coupling with balloon 24. Alternatively, front end 42 may be modified, without departing from the intended purpose of the present invention, and provided with multiple slits for coupling and supporting multiple water-filled balloons. In this case, suitable modifications to the size, weight and shape of tail 22 should be made to accommodate the additional load.

Figure 8:
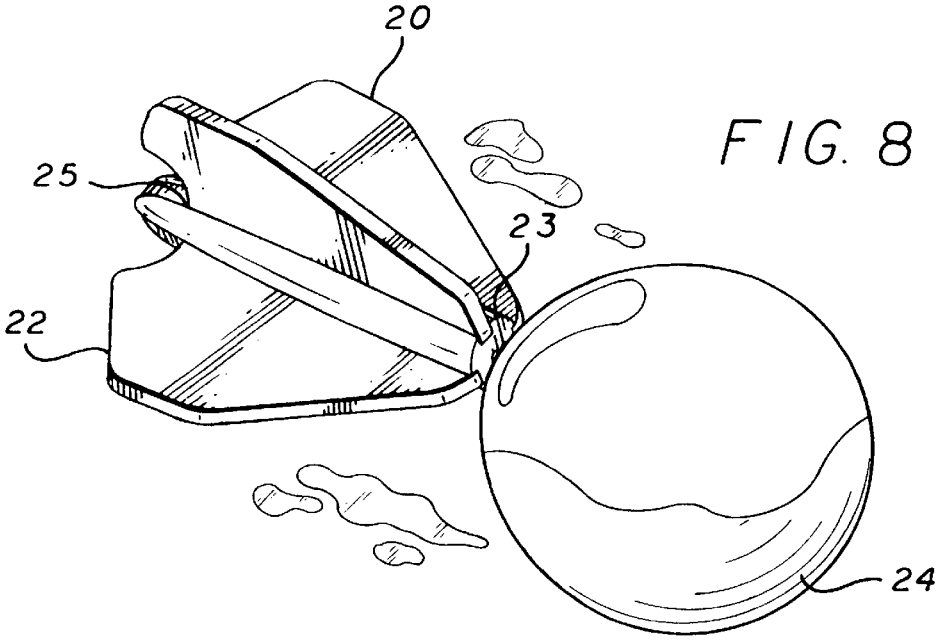
FIG. 8 is a front side perspective view of a water balloon dart in accordance with the present invention.
Figure 9:
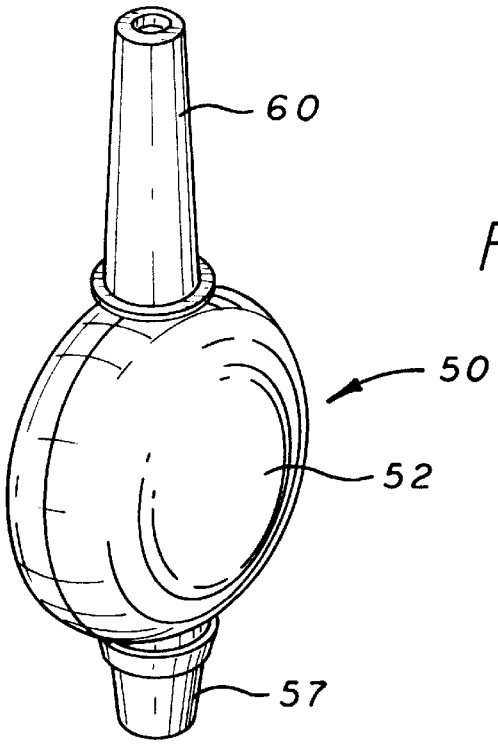
FIG. 9 is a front perspective view of a fluid pump for filling a water balloon.
Figure 10:
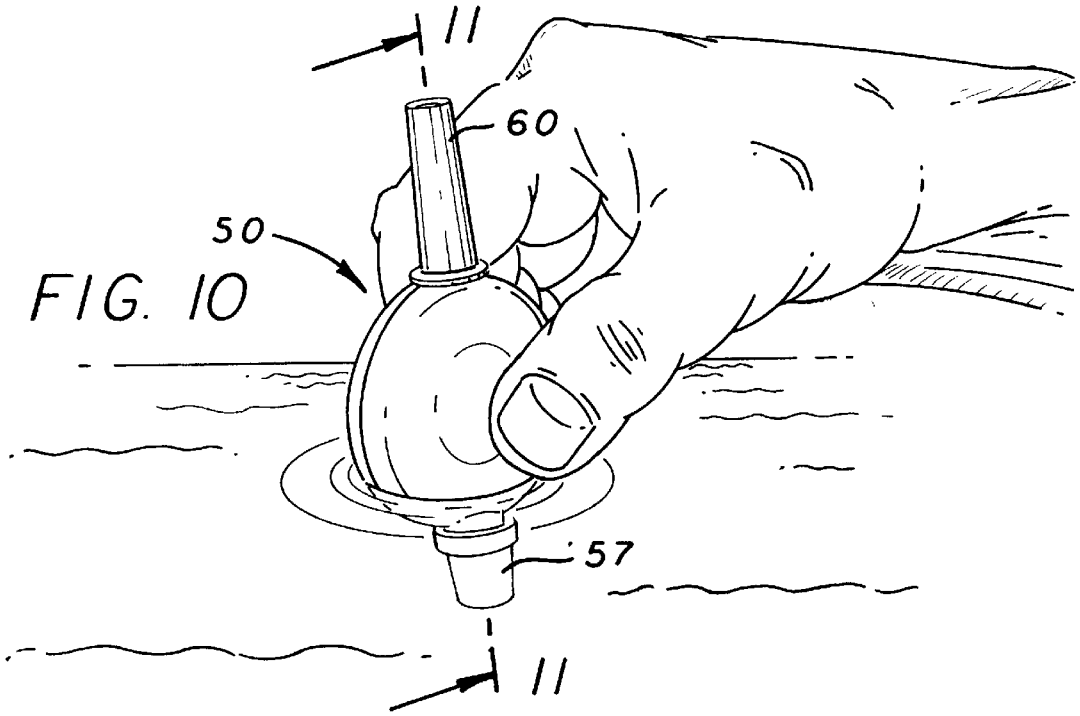
FIG. 10 is a front perspective view of the fluid pump of FIG. 9 with its inlet port in a body of water being primed.

FIG. 8 shows toy water-filled balloon dart 20 flying in the air like a real missile. The water-filled balloon 24 is shown securely coupled to front end 42 of tail body 28. It will be appreciated that balloon 24 is not limited to being filled with water, which is the preferred choice for users of toy balloon dart 20, but may also be filled with any other fluid suitable for the intended purpose of the present invention.

As described above, novel toy balloon dart 20 can be mass produced at a relatively low cost which makes it affordable by the general public.

Figure 11:
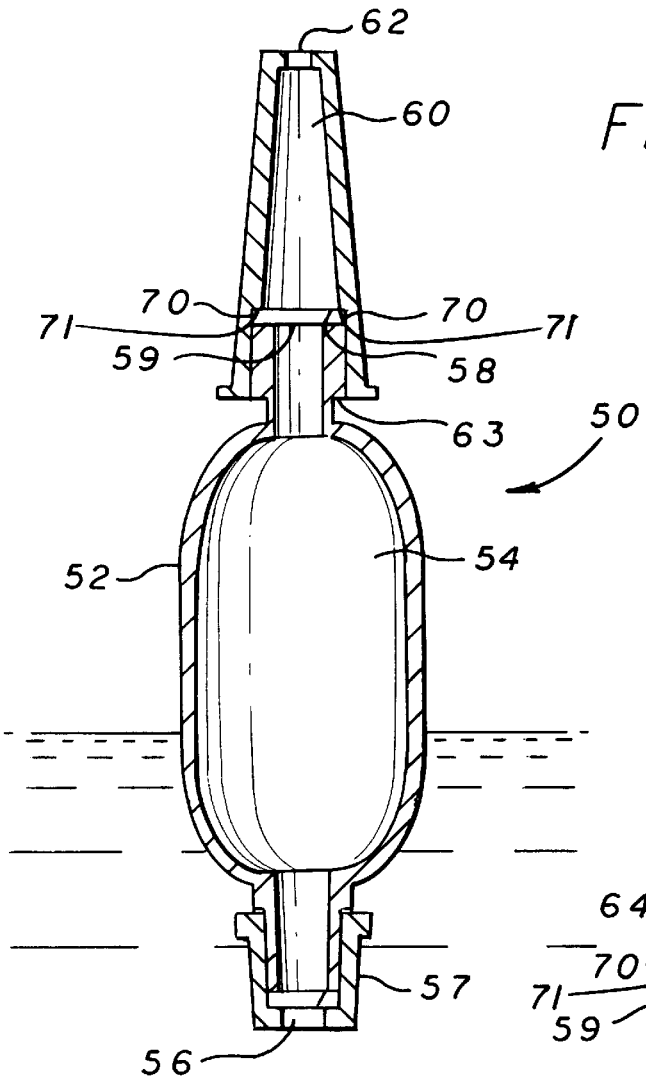
FIG. 11 is a longitudinal cross-sectional view along section line 3—3 of FIG. 10.

Referring to FIGS. 9–15, a fluid pump in accordance for use with the water balloon dart of the present invention is shown and generally referred to by the numeral 50. As shown in FIG. 11, fluid pump 50 comprises a housing 52 having a fluid reservoir 54 with a fluid inlet port 56 at one end and a fluid outlet port 58 at the opposite end. Fluid inlet port 58 has a circular configuration with an overall preferred diameter of about 0.3 inches. Fluid outlet port 58 also has a circular configuration with an overall preferred diameter of about 0.3 inches. Fluid reservoir 54 is flexible, roughly bulb-shaped and has generally an oval cross section. The preferred dimensions of housing 52 are: overall height about 2.75 inches, overall width (in its widest portion) about 2 inches and internal distance from side to side (in its widest part) about 0.8 inches. Housing 52 is preferably made of light-weight, flexible plastic although other materials may be used if they serve the intended purpose of the inventive device.

The top portion of reservoir 54 is capped by a nozzle 60 whose function is to inject fluid such as water into the neck of balloon 24. Nozzle 60 is designed to snap over the top portion of housing 52 enclosing fluid outlet port 58 which empties water under pressure into the interior of nozzle 60 during operation of the pump. Nozzle 60 is generally frustum-shaped, hollow inside and open on both ends with a relatively narrow top circular opening 62 and a relatively larger bottom circular opening 63. Top opening 62 serves to let water out of nozzle 60 and has a preferred diameter of about 0.125 inches.

As shown in FIG. 11, bottom opening 63 of nozzle 60 serves to let water inside nozzle 60 and has a preferred diameter of about 0.3 inches which allows it to snap over fluid outlet port 58 whose overall diameter is approximately the same. The preferred weight of nozzle 60 is about 0.05 ounces and the preferred height of nozzle 60 is about 1.25 inches. The top portion of nozzle 60 is dimensioned to fit snugly into the neck of a conventional water balloon to allow continuous water injection into the balloon. Nozzle 60 is also provided with an inner recess 70 which has radial symmetry and preferably has a side wall length (measured from bottom opening 63 upwards) of about 0.35 inches. FIGS. 11–14 show recess 70 rising from bottom opening 63 upwards and ending at edge 71 which projects radially inward. Nozzle 60 is preferably made of light-weight plastic although other materials may be used if they serve the intended purpose of the present invention.

The bottom portion of reservoir 54 is covered by a cap 57 which is open on both ends to allow fluid such as water flow into fluid inlet port 56. Cap 57 is generally frustum-shaped with a preferred weight of about 0.05 ounces. The hollow interior of cap 57 is dimensioned to snap over the bottom portion of housing 52 and completely enclose fluid inlet port 56. Cap 57 is preferably made of light-weight plastic although other materials may be used if they serve the intended purpose of the present invention.

Figure 12:
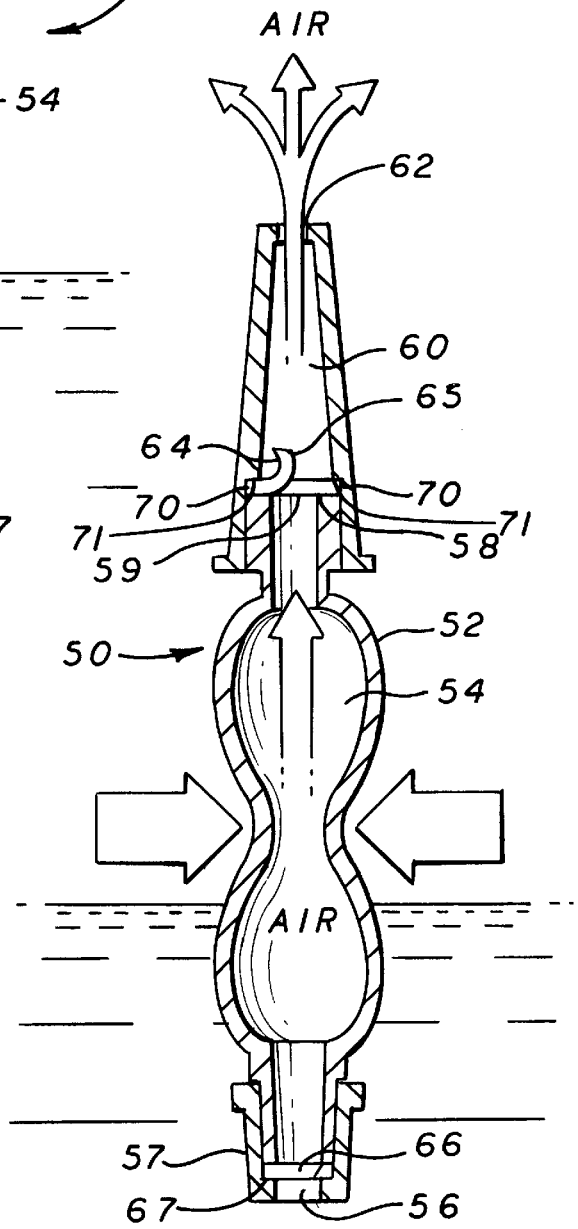
FIG. 12 is a longitudinal cross-sectional view along section line 3—3 of FIG. 10 with the pump being compressed to expel air from within the pump through the outlet port and nozzle.
Figure 13:
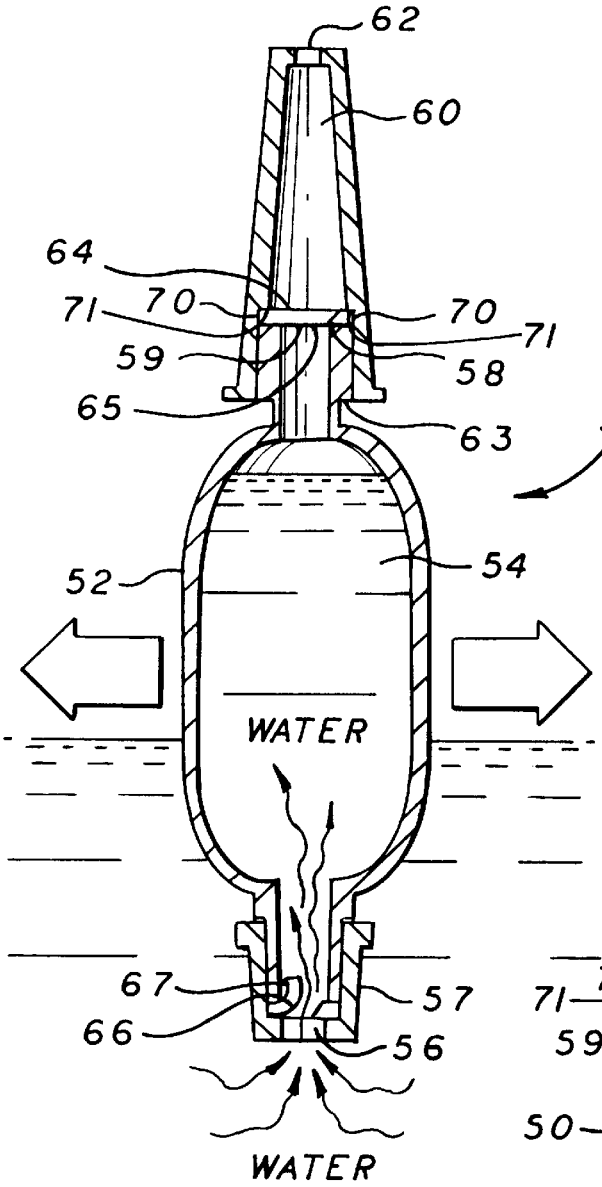
FIG. 13 is a longitudinal cross-sectional view along section line 3—3 of FIG. 10 with the pump being decompressed to suction water through the inlet port and into the pump in accordance with the present invention.
Figure 14:
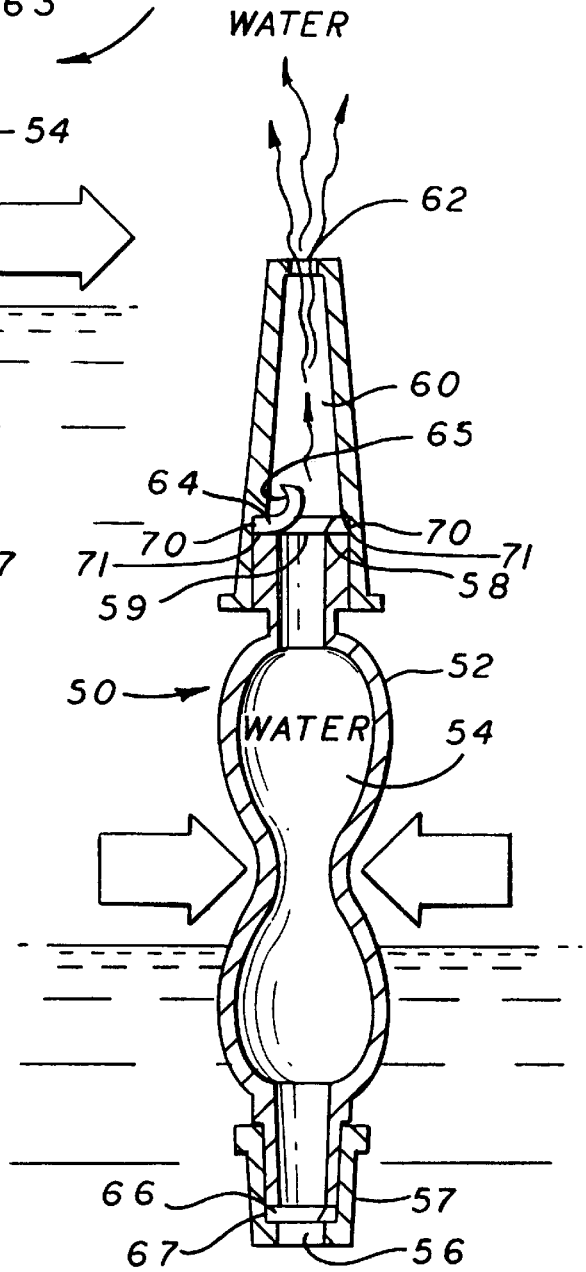
FIG. 14 is a longitudinal cross-sectional view along section line 3—3 of FIG. 10 with the pump being compressed to expel water through the outlet port and nozzle in accordance with the present invention.

Referring to FIGS. 12–14, pump 50 also includes a pair of valves for regulating fluid flow into and out of reservoir 54. In particular, FIG. 12 shows a valve 64 located inside nozzle 60 over fluid outlet port 58 in an open configuration. Valve 64 has a disk-like configuration with an overall diameter approximately the same as the overall diameter of fluid outlet port 58. Valve 64 is provided with an inner tongue 65 which is formed by a partial annular cut of the inside of valve 64 SO that when tongue 65 is up (valve 64 is open) it has a partial disk-like configuration while the rest of valve 64 has a partial annular configuration. An annular flexible washer 59 of roughly the same diameter as valve 64 and made of synthetic rubber is preferably positioned between valve 64 and fluid outlet port 58 to help lock valve 64 in place when nozzle 60 snaps over the top portion of housing 52 completely enclosing valve 64 and washer 59 inside.

When nozzle 60 is snapped over the top portion of housing 52, valve 64 is prevented from sliding upward in the interior of nozzle 60 by edge 71 which projects radially inward and is configured to abut the entire annular portion of valve 64 allowing tongue 65 of valve 64 to freely move upward (valve 64 is open) inside between e. Valve 64 is therefore securely sandwiched between edge 71 and washer 59 during operation of the pump. When valve 64 is open, water from the interior of reservoir 54 can pass via outlet port 58 into nozzle 60. Alternatively, as shown in FIG. 13, when tongue 65 is down (valve 64 closed) it closes outlet port 58 and enables suction of water into the interior of reservoir 54 through fluid inlet port 56.

FIG. 13 shows a valve 66 located inside cap 57 above fluid inlet port 56 in an open configuration. Valve 66 is identical in construction, dimensions, weight and make to valve 64. Valve 66 is also provided with an inner tongue, in this case tongue 67, which is identical to tongue 65 of valve 64. When cap 57 snaps over the bottom portion of housing 52 it completely encloses and frictionally secures valve 66 under fluid inlet port 56. When valve 66 is open, water from the outside body of water such as a pool, sink or pail for example, can pass via inlet port 56 into the interior of reservoir 54. Alternatively, as shown in FIG. 14, when tongue 67 is down (valve 66 closed) it closes inlet port 56 and prevents partial leakage of water through inlet port 56 into the outside body of water.

The operation of fluid pump 50 is designed so that whenever valve 64 is closed, valve 66 is open and vice versa. This permits the continuous water filling of balloon 24 when attached to nozzle 60 as described above as long as cap 57 is in constant communication with the outside body of water.

Valves 64 and 66 are made of flexible, light-weight, thin synthetic rubber although other materials suitable for the intended purpose of the pump may be employed.

The overall preferred weight of water pump 50 is about 0.35 ounces which makes for a portable and easy to use hand-held pump that can be used by adults and children alike. Other shapes and designs for the various components of the novel fluid pump may be employed. As described above, fluid pump 50 is constructed of a few relatively simple parts and can be mass produced at a relatively low cost which makes it affordable by the general public. Water pump 50 may be used with water or any other suitable fluid.

Referring again to FIGS. 12–14, the operation of the water pump is as follows. The user first completely immerses cap 57 which contains fluid inlet port 56 into a body of water. Next, the pump is actuated by manually squeezing the outside walls of the bulb-shaped reservoir 54 to remove air that may be present in the interior of reservoir 54. Compression of the outside wall of reservoir 54 increases the internal gas pressure on the inside walls of reservoir 54 and causes valve 64 to open thereby letting internal air out of reservoir 54 via fluid outlet port 58 into nozzle 60. Conversely, immediate decompression of the outside wall of reservoir 54 creates a suction effect inside reservoir 54 which causes valve 64 to close and valve 66 to open allowing water (from the outside body of water) flow inside reservoir 54 via fluid inlet port 56. Another compression of the outside wall of reservoir 54 closes valve 66 and opens valve 64 letting water under pressure inside nozzle 60 via fluid outlet port 58. Immediate decompression of the outside wall of reservoir 54 again creates a suction effect which closes valve 64 and causes valve 66 to open letting more water inside reservoir 54 via inlet port 56. Repeat manual compression/decompression of the outside wall of reservoir 54 by the user would eventually result in water squirting out of top opening 62 of nozzle 60. It will be appreciated that cap 57 must be kept immersed in the outside body of water at all times as noted above for the above operation to proceed and when water starts to squirt out of opening 62 of nozzle 60, then nozzle 60 should be inserted into the neck of balloon 24 for filling the same with water.

Figure 15:
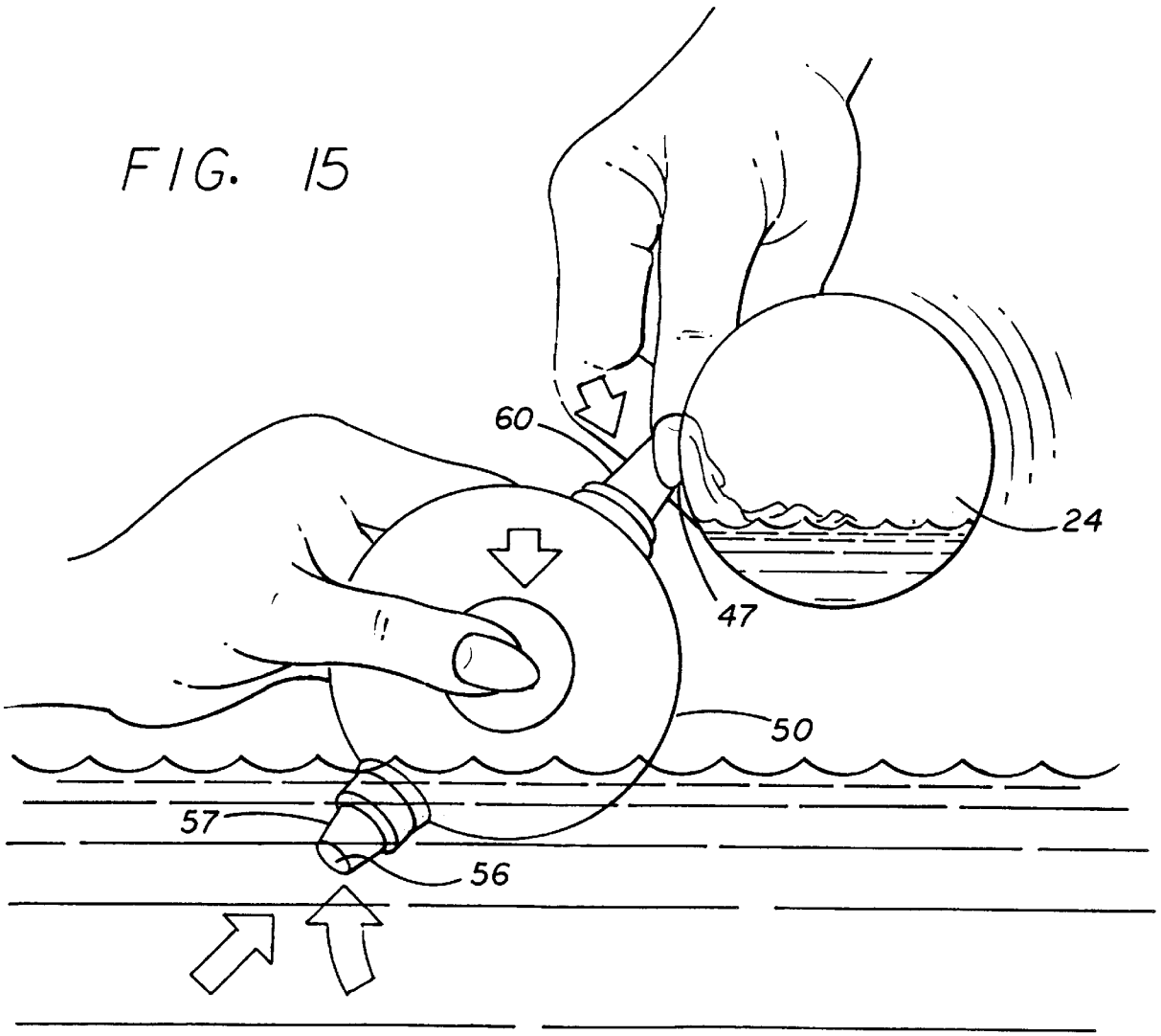
FIG. 15 is a front perspective view of the water pump of FIG. 9 being used to fill a balloon with water in accordance with the present invention.

FIG. 15 shows the injection of water into balloon 24 from nozzle 60. The user simply inserts nozzle 60 tightly into balloon 24, holds the balloon with one hand and fills the balloon with water squeezing pump 50 with the other hand.

The above-described inventive toy water balloon dart system is portable, inexpensive, safe for using, not harmful to the environment and can provide non-stop entertainment for children and adults alike.

While the invention herein has been described by means of specific embodiments, numerous modifications and variations could be made thereto by those skilled in the art without departing from the scope of the invention set forth in the claims.

What is claimed is:

1. A toy water balloon dart and pump system, comprising:

a tail for facilitating flight of said dart, said tail having a front end configured to receive a portion of a water balloon and a back end;

a balloon adapted to be filled with fluid having a portion for removable coupling to said front end of said tail; and a pump for filling said balloon with fluid, said pump having a flexible housing having a reservoir with an inlet port and an outlet port, a first valve associated with said inlet port, said first valve having an open position for permitting fluid to enter through said inlet port into said pump, and a closed position for closing said inlet port, a second valve associated with said outlet port, said second valve having an open position for permitting fluid to exit from said reservoir through said outlet port, and a closed position for closing said inlet port, whereby compressing said housing causes said first valve to be in the closed position and said second valve to be in the open position, and decompressing said housing causes said first valve to be in the open position and said second valve to be in the closed position enabling suction of fluid into said pump through said inlet port.

2. The toy water balloon dart and pump system of claim 1, wherein said tail has a body with a plurality of longitudinal fins spaced apart from one another extending along at least a portion of the length of said body for facilitating flight of said water balloon dart.

3. The toy water balloon dart and pump system of claim 2, wherein said body includes a slit at the front end of said tail for receiving and securing a portion of said water balloon, said body having a shaft-like configuration.

4. The toy water balloon dart and pump system of claim 3, wherein said body is in the shape of a hollow cylinder that is aerodynamically tapered in said back end.

5. The toy water balloon dart and pump system of claim 1, further comprising a nozzle coupled to said outlet port for injecting fluid into the water balloon and for securing said second valve over said outlet port inside said nozzle and a cap coupled to said inlet port for securing said first valve to said inlet port, said cap being open on both ends for allowing fluid flow into said inlet port.

6. The toy water balloon dart and pump system of claim 1, wherein each of said first and said second valves have a disk-like configuration with an inner tongue formed by a partial annular cut.

* * * * *